US005477798A

United States Patent [19]

Ness

[11] Patent Number: 5,477,798

[45] Date of Patent: Dec. 26, 1995

[54] HIGH STRENGTH, HIGH SAFETY SUBMERSIBLE VESSEL RESISTANT TO EXTREME EXTERNAL PRESSURES

[76] Inventor: C. Clifford Ness, 11 Willow La., East Lyme, Conn. 06333

[21] Appl. No.: 281,186

[22] Filed: Jul. 27, 1994

[51] Int. Cl.[6] ..... B63G 8/00

[52] U.S. Cl. ..... 114/65 R; 220/4.12; 114/312; 114/342

[58] Field of Search ..... 52/79.4, 79.1; 220/4.12; 114/312–314, 321–325, 339, 341, 342; 244/117 R, 119

[56] References Cited

U.S. PATENT DOCUMENTS

| | | | |
|---|---|---|---|
| 1,808,599 | 6/1931 | Galeazzi | 114/341 |
| 2,965,060 | 12/1960 | Asano | 114/342 |
| 3,413,947 | 12/1968 | Picard | 114/342 |
| 3,490,638 | 1/1970 | Elliott | 220/4.12 |
| 3,608,767 | 9/1971 | Elliott | 220/4.12 |

FOREIGN PATENT DOCUMENTS

| | | | |
|---|---|---|---|
| 40425 | 5/1965 | Italy | 114/312 |
| 0715120 | 10/1966 | Italy . | |
| 0279483 | 5/1928 | United Kingdom . | |
| 2223716 | 4/1990 | United Kingdom | 114/312 |

OTHER PUBLICATIONS

*Marine Technology,* "Seawolf Design for Modular Construction" Bevins et al., 1992, pp. 199–225.

*J.S.N.A. Japan,* "Study on the Hydrodynamic Characteristics of Circular Type Submarines", Murakami, var. 1973–1978, pp. 99–118.

*Primary Examiner*—Edwin L. Swinehart

*Attorney, Agent, or Firm*—Low and Low

[57] ABSTRACT

A submersible or submarine vessel having a unique pressure hull formed from a plurality of truncated spherical cells having at least one opening, wherein said cells are connected together in a generally loop array with said openings in confronting relation to define a interconnected internal space for utilization by personnel, equipment, or machinery. When said connected cells define a loop array having an open central area, dome means enclose the central area permitting utilization thereof, or, a further spherical cell or cells are disposed in the central area with access thereinto from a cell in the loop array for utilization, whereby at all times convexly curved spherical surfaces are exposed to high hydrostatic pressures, thereby to provide a maximum strength pressure hull.

19 Claims, 10 Drawing Sheets

HIGH STRENGTH, HIGH SAFETY SUBMERSIBLE VESSEL RESISTANT TO EXTREME EXTERNAL PRESSURES

BACKGROUND OF THE INVENTION

Throughout the long history of submersible and submarine vessels a chief design and structural goal has been to provide a submarine or other underwater vessel having the capability of withstanding extreme external underwater pressure, which is directly related to functional depth operations, and also to be capable of maintaining structural integrity during rapid pressure changes due to necessary or accidental transitions of depth.

Collateral thereto is the necessity of ensuring safety to the occupants or crew within the submersible, and more particularly in the pressure hull thereof by virtue of the pressure hull strength, while yet providing a relative maximum amount of volume area for workspace and equipment space therein. In comparable manner, a submersible or submarine vessel must be capable of maximum speed of travel through the sea by virtue of streamline form, while yet maintaining high structural rigidity.

Development over many years, including the intense active engagements in two World Wars, have largely resulted in the development of submersibles and submarines having pressure hull configurations essentially of cylindrical or cigar-like form, having an external hydrodynamic form streamlined to suit surface operation, thus evolving an elongated, essentially linear, internal volume for habitation and machinery compartmentation, utilizing the inherent hoop strength of a small diameter and circular cross-section to adequately resist depth pressure. While this form has been and is universally employed for submarine form, the same are more suited for withstanding internal pressures, in an engineering sense, than an external hull collapsing pressure, the latter of which is a principal area of concern in submersibles and submarines.

Further advancements toward high underwater speeds and nuclear propulsion created the need for larger displacement hulls, significantly increasing the cylindrical hull diameters, and demanding the use of exotic and costly metallurgy to achieve the required hull strength, with attendant large increases in fabrication costs. This developmental change in submarines resulted in redefining the hydrodynamic form to suit a fully underwater operation, and introducing large single hull construction and shifting variable ballast systems away from amidships.

The demand for increased size has extended the overall hull length beyond the generally accepted length over diameter ration of six-to-one. The diameter is restricted by the draft limitations of harbors, and the increased structural requirements for enlarged diameter hulls. This ratio has proved unattainable throughout the twentieth century.

The need to limit growth in the vertical profile has in some instances required designers to employ two parallel laterally adjacent cylindrical pressure hulls to accommodate larger displacement, thereby shortening hull length and draft, and avoiding excessive wetted surfaces. Despite such efforts, the factors of limited depth capability and very high cost of construction are not alleviated. Further, the general cylindrical form of the pressure hull is not materially altered, even into very recent times. See, illustratively, the discussions of submarine design in *Marine Technology*, "SEAWOLF Design for Modular Construction", October, 1992 commencing at p. 199. It is noted, for example, that bulkheads in the SEAWOLF class submarines have diameters on the order of 40 feet, and an area of some 1,256 square feet each, with resultant serious and expensive fabrication and pressure resistance problems to be overcome in building the hull.

There is manifestly indicated a need for a pressure hull design that is far more structurally efficient, significantly less costly, and yet satisfy the volumetric demands of modern submarines. Further, and correlative thereto, there is practical and necessary interest in an improved submersible that would have a more shallow draft as compared to present constructions.

BRIEF SUMMARY OF THE INVENTION

The present invention embraces the use of interconnected cells or chambers, having spherical curvatures, to form the pressure hull, and wherein the working volume thereof, occupied by crew and equipment, is maintained at substantially one atmosphere irrespective of craft depth. While such shapes have been known in very general terms for submarine hulls and to a very limited extent hitherto, as in U.S. Pat. No. 3,413,947 to Picard or in Italian Patent 715,120 and British Patent 279,483, the prior development is only incipient in concept and not suggestive of advanced structures of such character of the present invention.

In the present invention, the utilization thereof in especially unique forms, as a hexagonal, looped, or arcuate array of spheres (or cells) for personnel and equipment, inter alia, results in the provision of massive structural strength of the submersible or submarine against the external hydrostatic pressures at great depths or during cycles of changing pressure during dive or ascent. Yet with exceedingly high pressure resistance and interior volume or space for all needed personnel, equipment, and machinery, the bulkhead height can be reduced to less than half that of conventional submarine bulkhead diameter, with resultant reduced wetted area and lower power requirements for the same speed.

In a principal form of the invention, a looped array of six such cells or modules defines a central opening or void which receives a seventh cell of similar or greater diameter than the other cells, which seventh cell significantly reinforces and buttresses the hexagonal array, and wherein further, all cell intersections form flat vertical bulkheads.

Such an arrangement, in broadest terms, may be said to resemble a so-configured cluster of soap bubbles. This preferred hexagonal form as naturally occurs in snowflakes, honeycombs, and divers crystalline formations in nature is regarded as having the greatest strength as well as the most efficient integrated application of structure. In the present invention, as applied to submersible craft, further extension of this cellular structure by the addition of other looped arrays will provide the needs of even larger displacement hulls, and without resorting to the difficulties or even impossibilities of hulls of ever increasing diameters, and in preference to increasing cell spherical diameters in the present invention.

In like manner, a structured array of similar but smaller spherically curved cells, interconnected in clusters or groups of three, four, or five, and having similar common vertical bulkheads, are suited to smaller submarine applications, as for marine research or special testing.

Relatively low vertical profile, shallow draft hull configurations following from utilization of the pressure hull of the invention provide yet the further advantages of a more sleek hydrodynamic external hull for surface and subsurface speed and maneuverability.

Other objects and advantages will become apparent from the detailed description of the invention hereinafter.

BRIEF DESCRIPTION OF THE DRAWINGS

The invention will be better understood in conjunction with the accompanying drawings, in which.

DETAILED DESCRIPTION OF THE INVENTION

Figure 1:
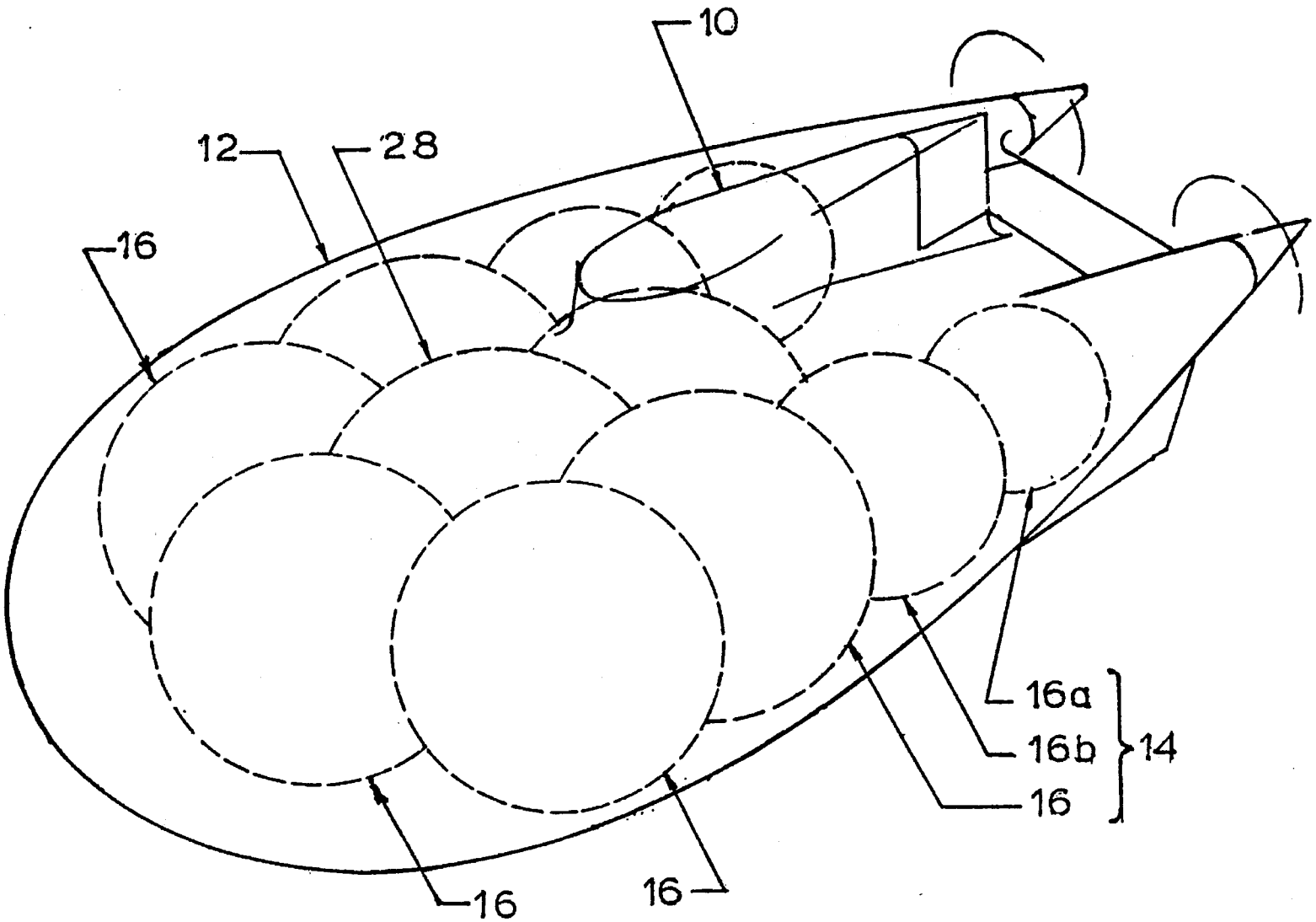
FIG. 1 is a general perspective illustration of a shallow draft submersible of the invention wherein the spherical cell structures forming the pressure hull thereof lie within the exterior streamlined hydrodynamic hull.

To facilitate quick reference to the drawings and the following description, the following glossary of reference characters is provided:

H1 - hemispherical head member of cell

H2 - spherically curved center section member of cell

10 - overall shallow draft submarine or submersible

12 - hydrodynamic outer hull

14 - pressure hull of spherical cells within outer hull

16 - truncated spherical cell

18 - exoskeleton between inner and outer hulls

P20 - welded seam between upper H1 and H2

22 - truncated opening in cell

P24 - welded seam between lower H1 and H2

26 - rigidifying hoops between cells

28 - central core including bulkheads, and upper and lower hemispherical caps

30 - welds between cells

32 - four cell array with center core

34 - four cell array without center core

36 - three cell array without center core

38 - bulkheads between cells

40 - domes over central core area

In FIG. 1 an illustrative shallow-draft submersible or submarine 10 according to the invention is shown wherein the exterior hydrodynamic hull 12 is appropriately and preferably streamlined. In the illustrative form, the same is somewhat of a flattened ellipsoid configuration similar in broad respects to a manta ray, but it is to be understood that any alternative external effective submarine hull configuration may be used within the spirit of the inventive concepts herein. The unique and inventive pressure hull of the invention is defined by the connected plural spherical cell working volume within the exterior hull 12 of submarine 10 is generally indicated in dashed lines at 14 in FIG. 1.

As such, the same presents for general understanding an overall illustration of a submersible/submarine, wherein the several internal cell spheres define the pressure hull of maximum resistance to high and changing or cycling sea hydrostatic pressures, while the outer skin or hydrodynamic hull 12 is not subjected to pressure extremes in usual manner by the presence of water pressures or air pressures between the external hull and the cells providing the crew, equipment, and machinery working space within the cells 16 which space is normally and necessarily and customarily maintained at about one atmosphere of pressure for normal functioning of crew and equipment.

Further, so far as propulsion power, whether nuclear, diesel, or any defensive or offensive armaments are concerned, as well as control surfaces and the like, the submersibles of the invention may be provided as desired with the same in known manner, and which do not form a part of the present invention.

Figure 6:
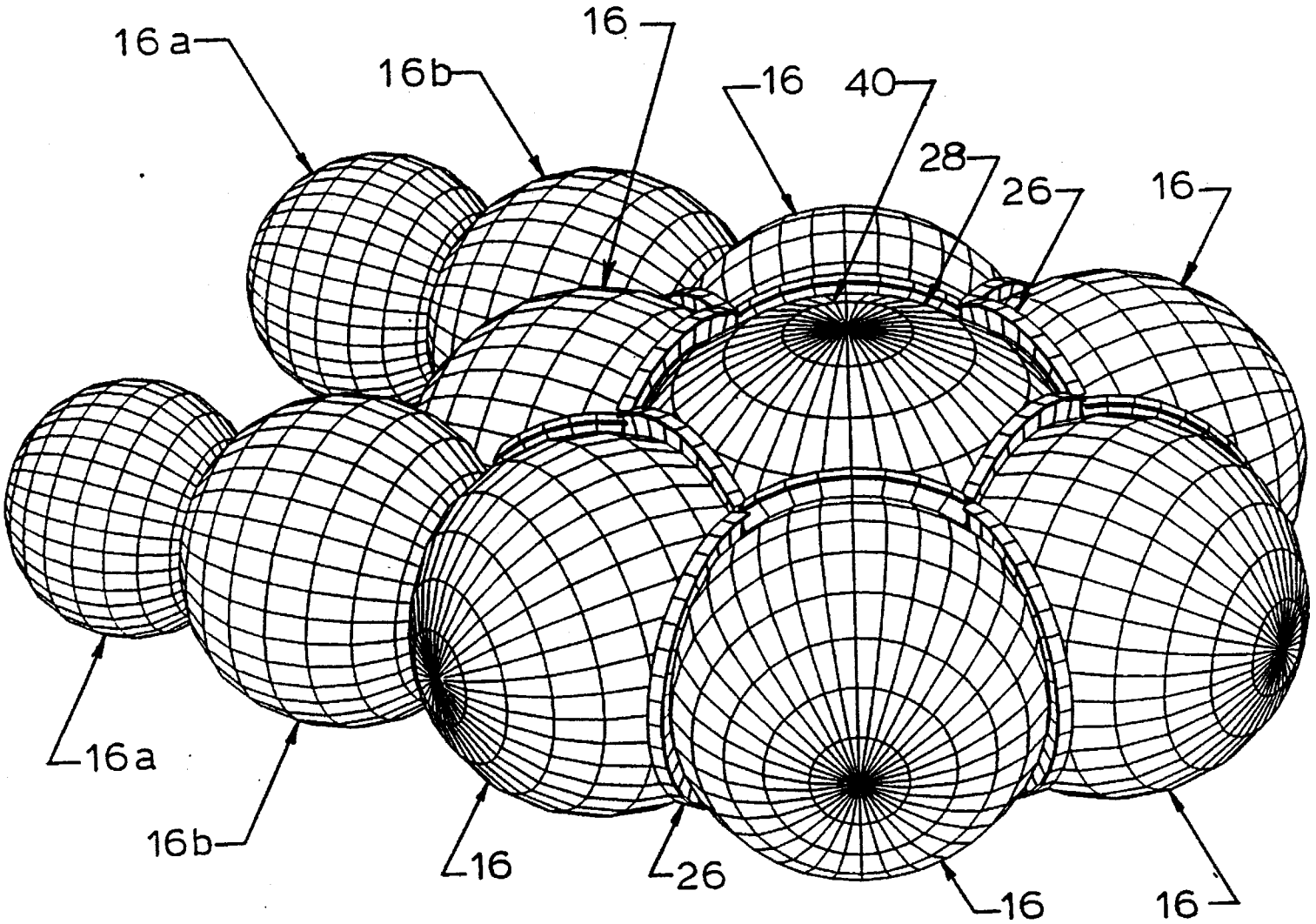
FIG. 6 is a view similar to FIG. 5, but further illustrating adjacent spherical cells or chambers, as may be employed for propulsion machinery compartmentation.

As indicated disposed within the exterior hull 12 is the pressure hull 14 of the invention. The same is formed from a plurality of substantially spherical cells 16, a single one of which is illustrated in enlarged form in FIG. 2. The checked pattern thereon does not represent a structural feature, but is provided for clarity of illustration as to internal and external relationships. The cells 16 are substantial in size thereby to accommodate crew, living quarters, and equipment, etc., all as is customary in submarine and submersible vessels. The diameter and number of spherical cells 16 may be greater or smaller as needed. For example, in FIG. 6, the cells 16*a* or 16*b* are attached to the major six-cell volume array may be of different size than the principal cells 16. As thus seen in FIG. 6, the cells 16*a* and 16*b* attached to hexagonal array of cells 16 are diametrically sized to accommodate the external hydrodynamic hull 12, as well as is necessary to accommodate crew, equipment or machinery therein. The aforementioned patent to Picard U.S. Pat. No. 3,413,947 is illustrative of differing cell sizes for varying purposes.

Figure 2:
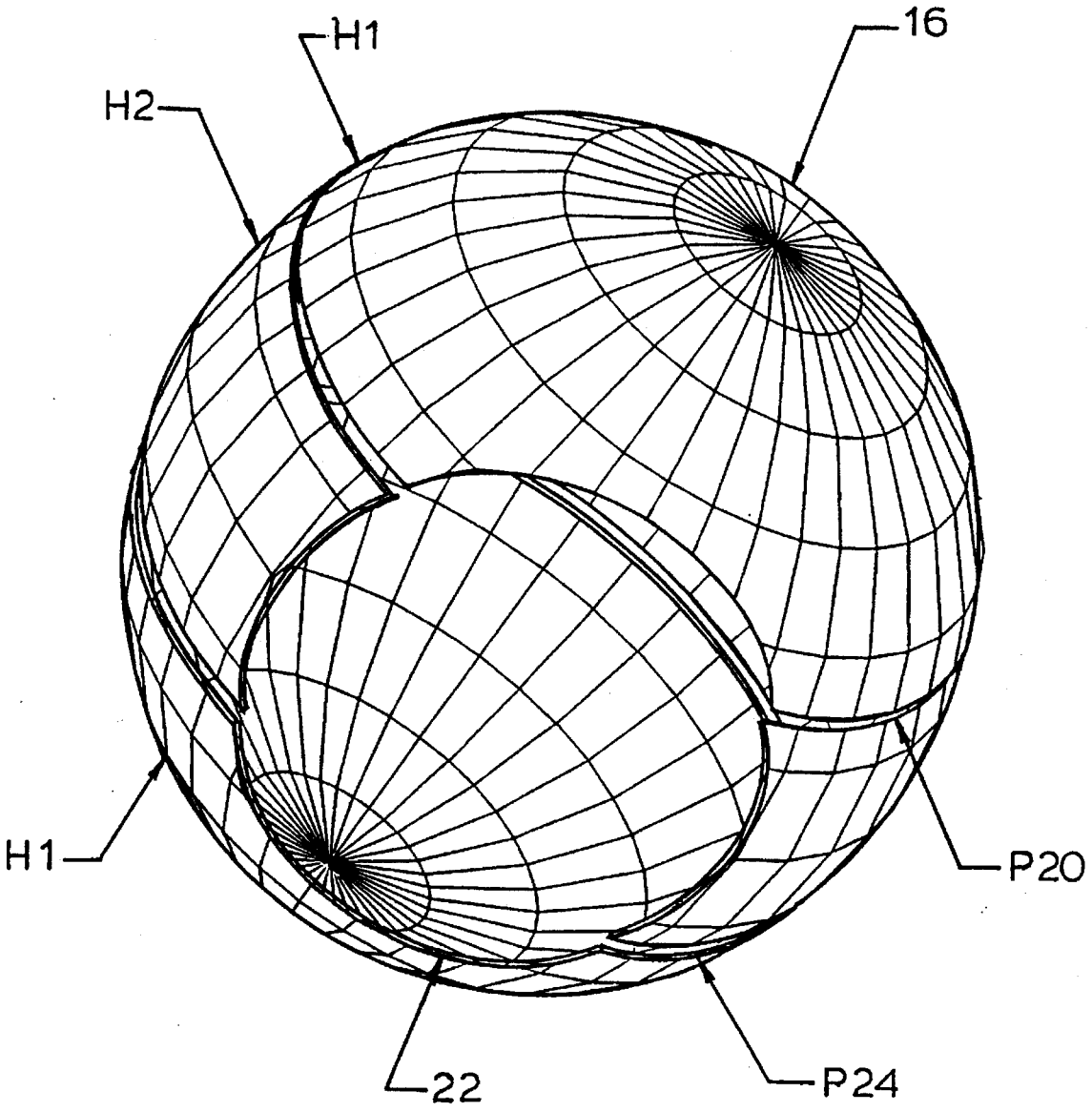
FIG. 2 is a single truncated spherical cell according to the invention.

The cells 16, as shown in FIG. 2, can be manufactured and fabricated from selected steel, crafted alloys, or exotic metals as necessary to meet depth/pressure requirements and manufacturing considerations. Techniques for formation of spheres 16 employ current fabrication techniques which are applicable to both commercial and military markets, and as such can conform to all ANSI, MIL-SPEC and other applicable inspections as necessary to insure structural integrity.

Preferably, again for ease of manufacture, the cells 16 are provided and assembled for each cell in two hemispherical sections H1, H1 and a generally part-spherical section H2 as generally indicated in FIG. 2. The upper and lower hemi-heads H1, H1, are respectively joined to center section H2 along globe-like parallels P20 and P24. Such hemispheric connection is made by welding.

Figure 3:
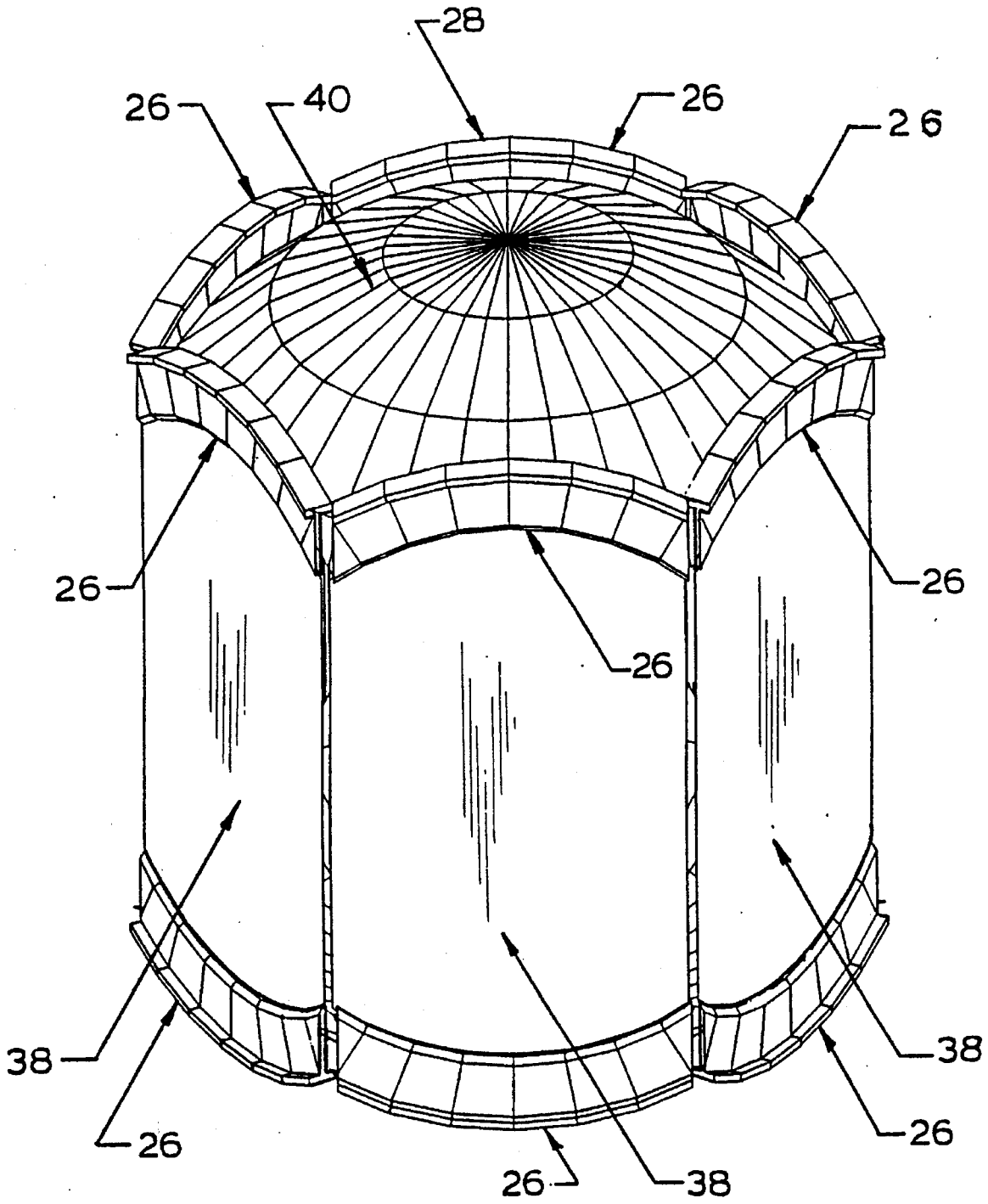
FIG. 3 is an isometric view of a seventh cell which occupies the central area of an hexagonal six-cell open center array.

As indicated, several of the cells 16 are serially connected as in the hexagonal matrix of FIG. 3, for example, and along with added cells 16*a* and 16*b* form the basic pressure hull 14 seen in FIG. 1.

In order to provide communication between the cells 16 and appropriate access by personnel and to equipment, each cell 16 that is connected to an adjacent cell 16 is truncated or hemispherically incomplete to define an opening or openings 22 of desired size to permit passage of personnel, equipment and connections therethrough as necessary in the assembled hull 14, as noted further hereinafter. In order to maximize the strength of the structure through the spherical curve of each cell 16, the size of the opening 22 is as small as reasonably feasible, extending preferably not over about 60° of arc.

Figure 7:
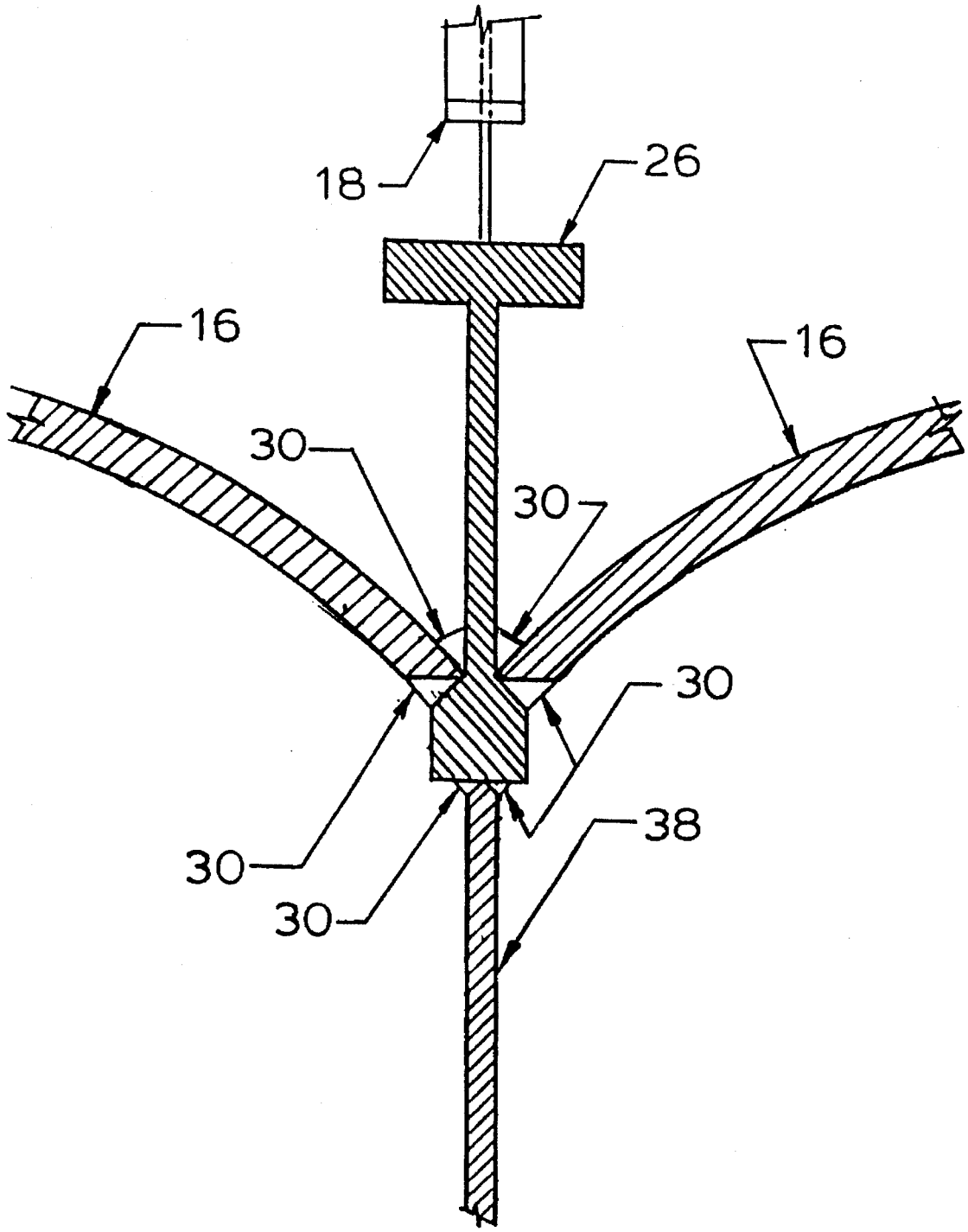
FIG. 7 is a hoop diagram of a potential method of intersecting the spheres or cells with each other and a fragmentary exoskeleton structure.

The spherical cells are sealingly connected to each other at the openings 22, which are preferably peripherally flanged thereat, by weldments and like means. To rigidify and strengthen the connection, a separate annulus or hoop 26 as diagrammatically seen in FIG. 6 and in partial section in FIG. 7 extends completely about each pair of the confronting openings 22 of adjacent cells 16, and is secured to each spherical member as by welding seen illustratively at 30, FIG. 7.

Figure 10:
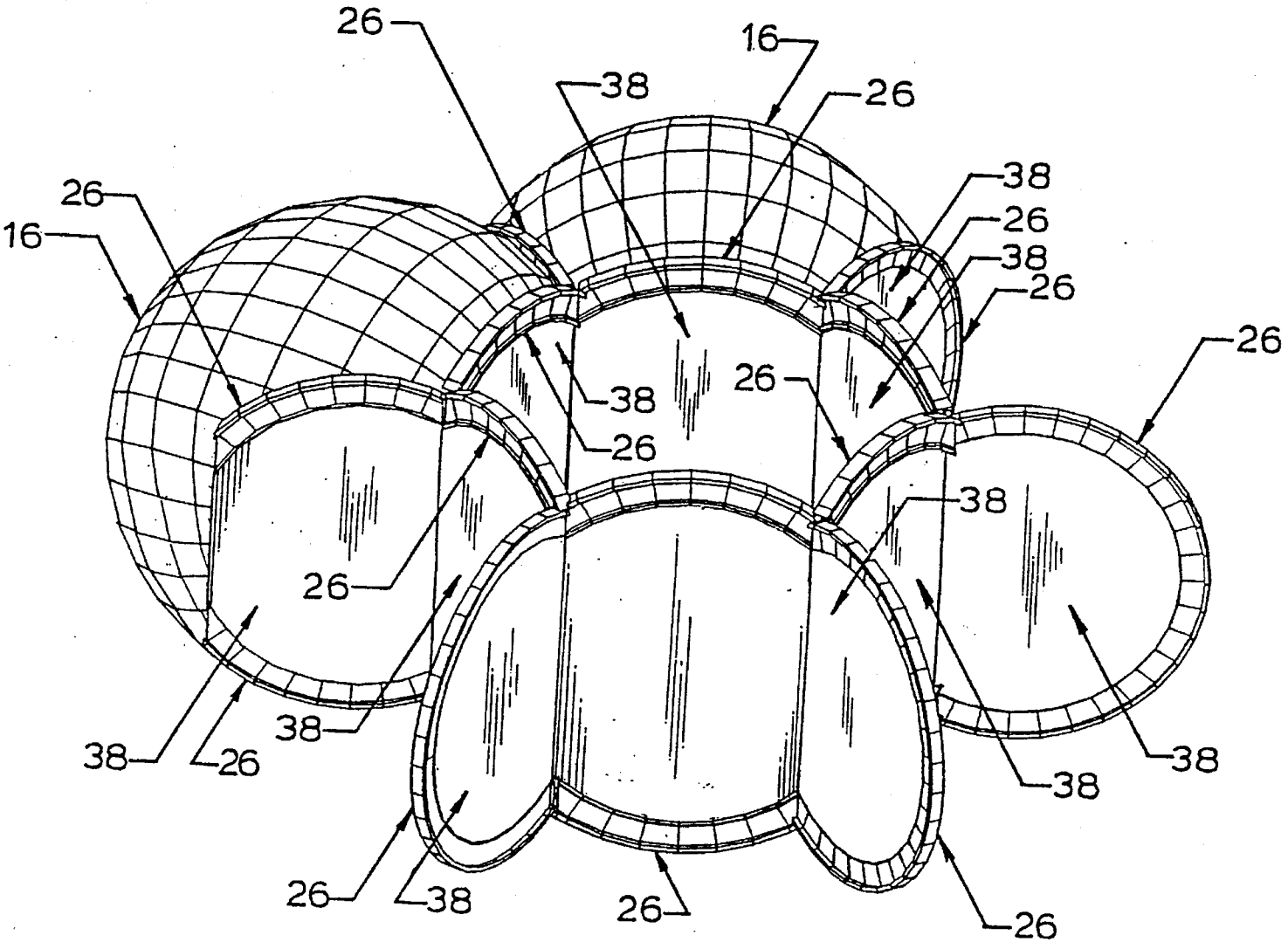

Within the hoops 26 at the cell junctures suitable bulkheads 38 are provided with appropriate hatches therethrough. FIG. 10 illustratively shows such bulkheads in diagrammatic form to demonstrate clearly the relationship of the bulkheads to the pressure hull. In this regard, the unique hexagonal array with the bulkhead locations as shown provides maximum safety and strength with minimum usage of material. Thus, as illustrative of a cell and bulkhead dimensioning in accordance with the invention as compared to conventional cylindrical form submarine practice wherein a usual bulkhead may be 30 feet in diameter:

Example:

Cell 16 Diameter = 30 Feet;
Diameter at Bulkhead 38 = 15 Feet

Submarine bulkhead area herein = 7.5>> Ð= 176.715 Sq. Ft.

Conventional bulkhead area = 15.0>> Ð= 706.858 Sq. Ft.
Reduction in Steel Required for Each Bulkhead Construction:
176.715 − 796.858 = 25%, or a 75% Reduction in Steel As above indicated, volumetric requirements of cylindrical submarines are immense, whereby submarines use 40 foot diameter bulkheads, with therefore an area in excess of 1,250 sq. ft. In the present invention with the horizontal array of cells 16 providing vast volume space with the other advantages as noted, it is expected from design considerations that the maximum bulkhead diameter will be only 16.5 feet with a maximum area of 213.8 square feet, with resultant massive reduction in material, cost, and weight.

At a selected point or points in the connected array of cells 16, access ports and air locks from the outside may be had as necessary for personnel or equipment connections, the same having appropriate sealable hatches, as is well known in submersible or submarine construction. Further, to the extent feasible, necessary penetrating connections can be made at the junctures of cells 16, thereby maintaining to the maximum extent possible the structural and leakproof integrity of the spherically curved system.

The hoops 26, circular in form and rigidified by their mechanical association with the spheres 16, form attachment points for the exoskeleton 18 extending between the pressure hull 14 and the external hull 12, thereby along with companion trusses and reinforcing means therebetween providing an effective exoskeleton 18 supporting the hydrodynamic hull 12 about the pressure hull 14. In so doing significant reinforcement against bending stresses directed toward the pressure hull is provided. Further, the integrated nature of the spherical cells 16 permit as needed, or in the event of accident, a free flood area and volume between the hulls without jeopardizing the pressure hull integrity.

Figure 8A:
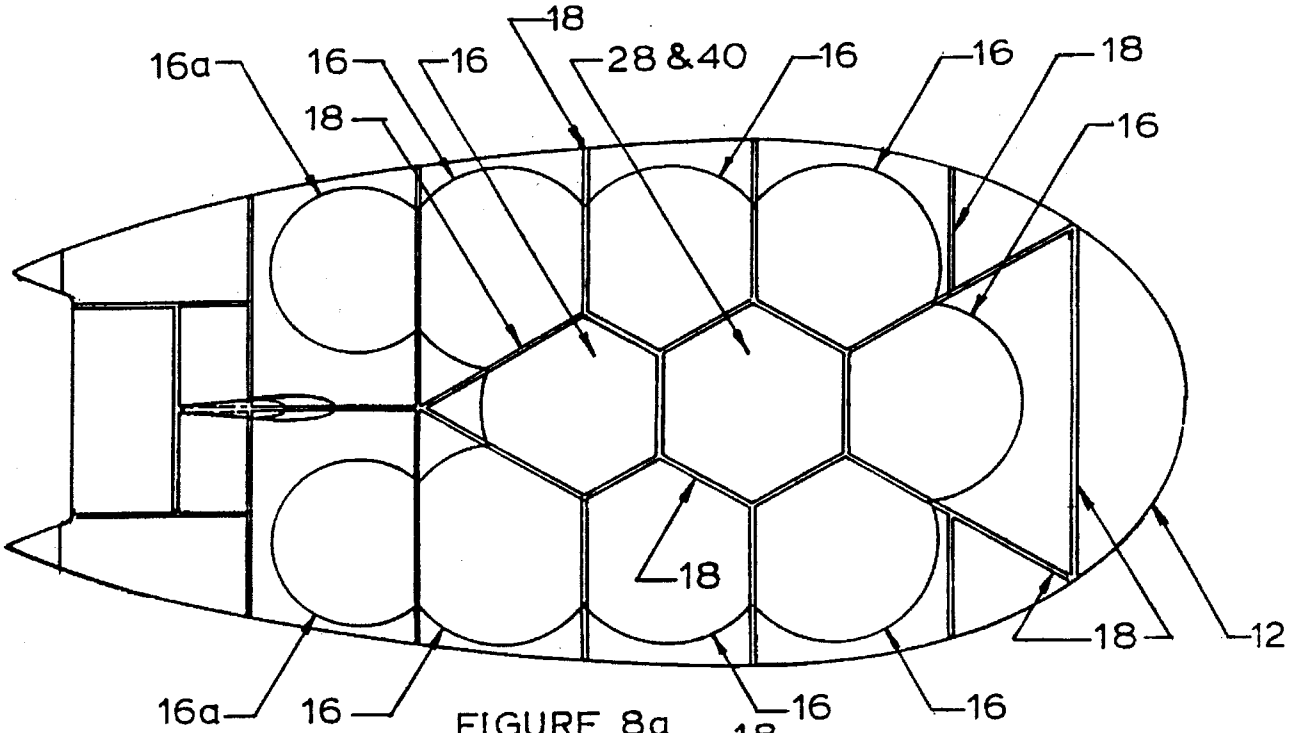
FIG. 8*a* is a diagrammatic plan view of an exoskeleton structure tying the several cells and the outer hydrodynamic hull together, including the bulkheads at each cell juncture.
Figure 8B:
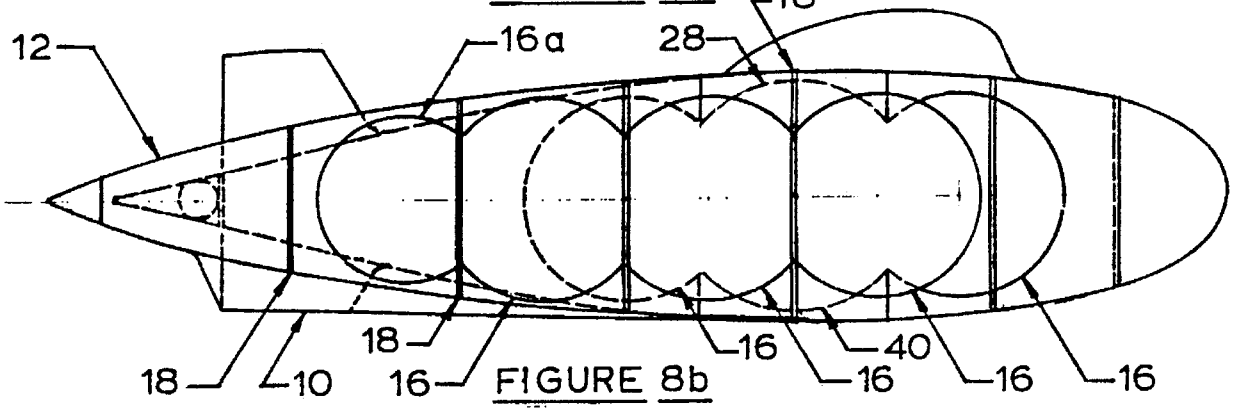
FIG. 8*b* is similar to FIG. 8*a*, but is a side view.

A further function of the looped array of cells 16 is the multiple access to each cell from up to three adjacent cells, with resultant improved safety and work or maintenance access, in striking contrast to the limited linear arrangement of usual compartments in a conventional cylindrical submarine. By way of example, a flooding of a mid-compartment of a conventional submarine can eliminate access between forward and aft compartments on wither side thereof. In the subject invention, in the array of FIG. 8*a*, for example, flooding of any one or in most cases even two cells does not block access to all others.

Figure 4:
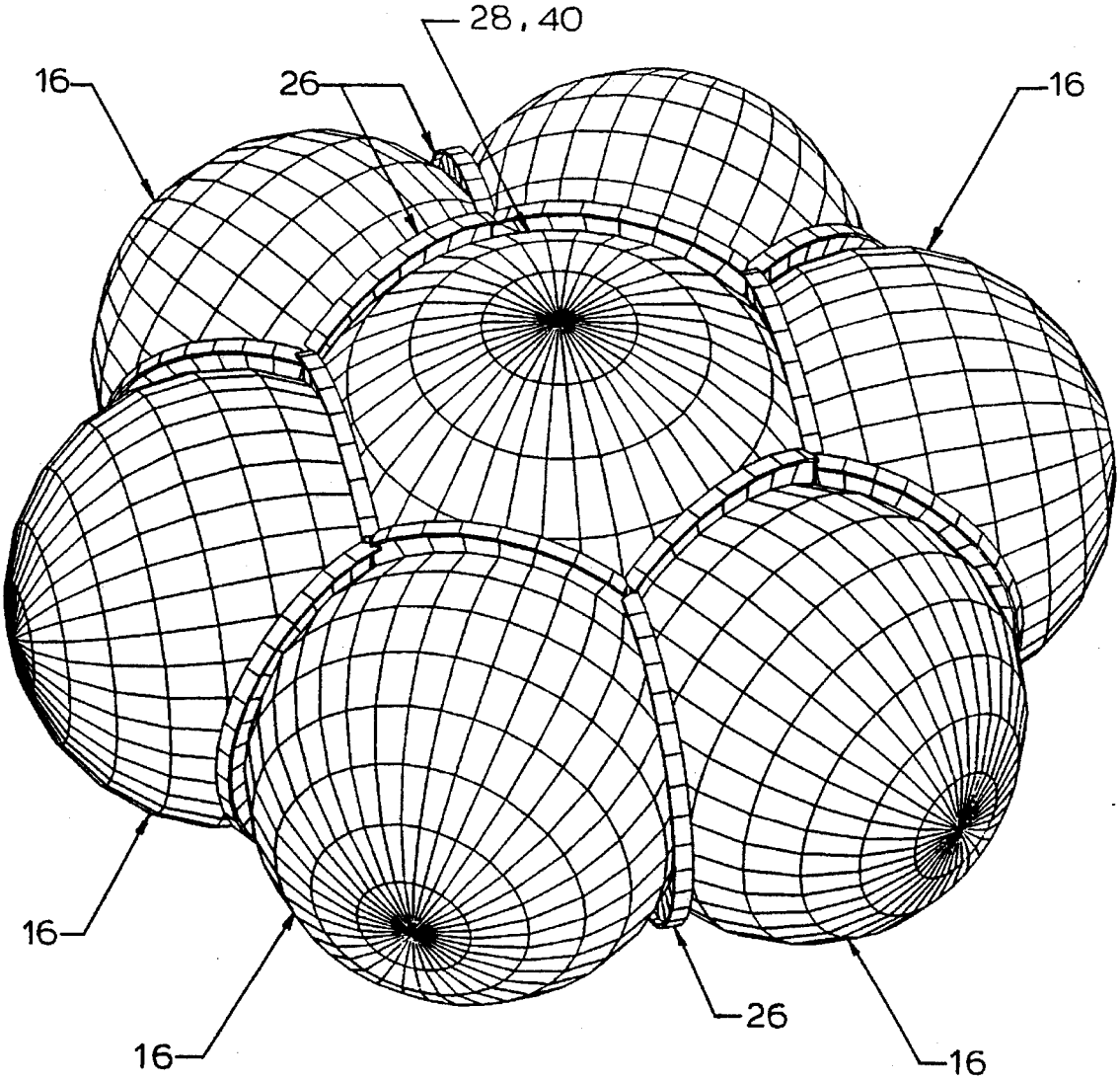
FIG. 4 is a diagrammatic isometric view of a hexagonal array of cells including the illustration of a top dome or cap which creates a hexagonal-sided prismatic core.
Figure 5:
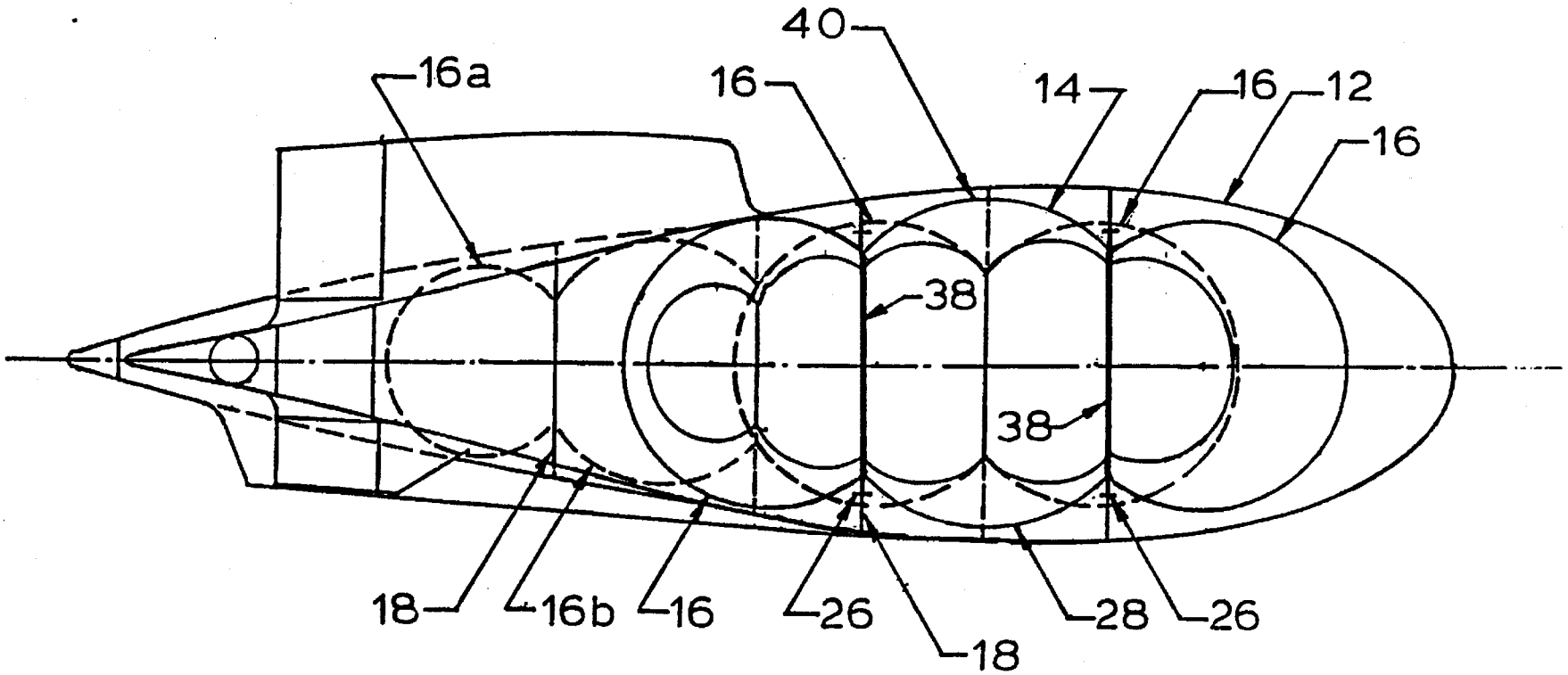
FIG. 5 is a diagrammatic side view of a hexagonal prismatic core with an array of satellite cells generally similar to FIG. 1.

As indicated, in one form of the invention, an array of six cells 16 is of hexagonal form as in FIGS. 4 and 5 thereby to define a central open area or core 28. The array is further immensely strengthened by the provision of part-spherical upper and lower domes 40. Domes 40 have their peripheral skirts scalloped or contoured so as to seat upon and be complementary with the contiguous surfaces of the six spherical cells 16, and are sealed thereto as by welding.

By so doing, the arched part-spherical domes not only impart additional strength to the hexagon array, but also convert the core space into an integral part of the pressure hull volume for use. Accordingly, one or more of the spherical cells 16 may be provided with access ports on an inside arcuate face to as to permit utilization of the now-closed core space 28.

Figure 9A:
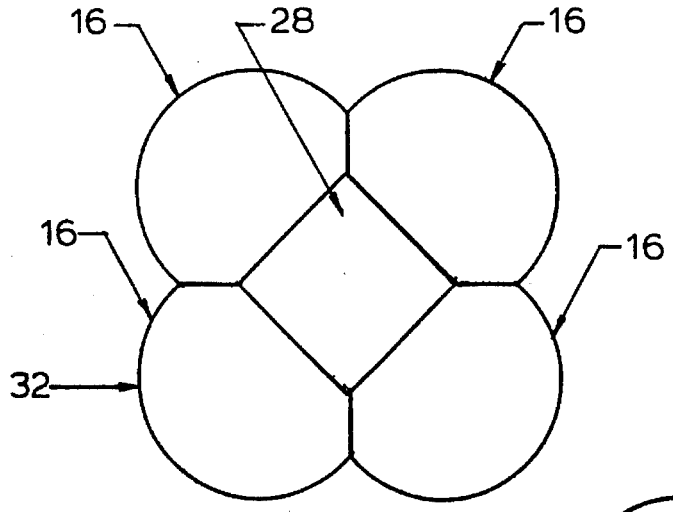
FIG. 9*a* is a diagrammatic illustration of a modified form of pressure hull having four connected cells as well as a central core or opening.
Figure 9C:
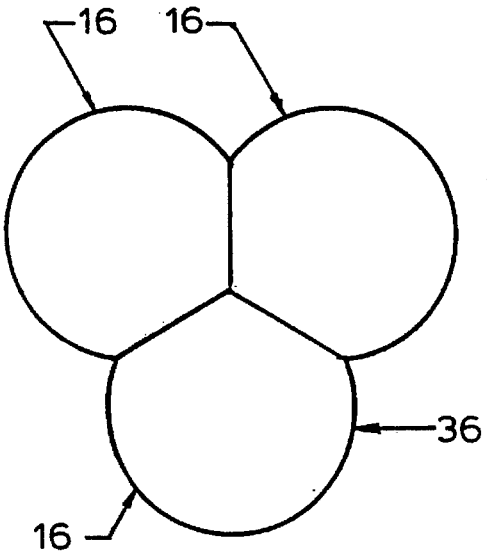
FIG. 9*c* is a diagrammatic illustration of a yet further modified form of pressure hull having three connected cells with no central core or opening; and, FIG. 10 is a diagrammatic illustration of the bulkheading arrangement as applied to the preferred hexagonal array of cells, suggesting watertight, damage control, and pressure holding compartment arrangements.
Figure 9B:
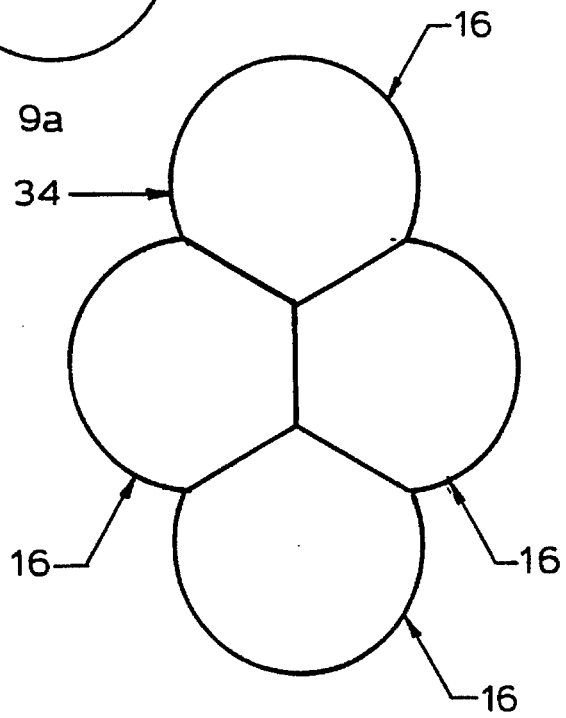
FIG. 9*b* is a diagrammatic illustration of a further modified form of pressure hull having four connected cells with no central core or opening.

The foregoing description has emphasized the utility and volume of a hexagonal array of six cells 18. It is evident that five such cells arranged in a pentagon, or other circular arrays may be provided to gain a central space which may be closed by domes similar to those at 28, as in the four-cell array of FIG. 9*a*, or may have other arrangements without a central core section between the array of cells 16, as in FIGS. 9*b* or 9*c*, for example.

It will be seen that in all forms of the invention, all exterior surfaces of the pressure hull are spherically convex for maximum strength and resistance to undersea external hydrostatic pressures. Further, by use of the common spherical form for all components, and including the part-spherical form of the domes, a maximum reduction in fabrication costs is obtained.

While disclosed in the context of submersible or submarine construction, to which the system is most apt as a radical improvement over existing submersible structures, it is evident that the concepts herein may be utilized in many other environments than that of personnel and subsea vehicles, as for example, diverse forms of fluid handling equipment, whether liquid or gaseous, which may or may not require protected personnel and machinery, as in offshore subsea wellhead operations, inter alia.

What I claim is:

1. A pressure hull for submersibles or submarines comprising a plurality of substantially spherical cells, each said cell being truncated at at least one point to define an opening of limited arcuate extent communicating interiorly of said cell, said cells being arranged in a closed loop array with a said opening in each said cell confronting a like opening in the next adjacent said cell, and with said array defining an open area centrally thereof, an additional said cell disposed in said central area and having a said opening therein, wherein further at least one of said loop array cells has a complementary opening communicating with said additional cell, means fixedly securing said cells to each other in leakproof relation at said confronting openings, thereby to define a connected internal space between at least two said cells for utilization, said fixedly securing means including a circular reinforcing hoop disposed between said cells in surrounding relation about said confronting openings and secured to each adjacent cell thereat, and, at least one access port on the outer face of at least one said spherical cell for entry to and exit from said cell internal space.

2. The pressure hull of claim 1 wherein said openings each extend over an arc of no greater than about 75°.

3. The pressure hull of claim 1 wherein each said loop array cell has a pair of said openings, thereby to provide a continuous said internal space interconnecting all said loop array cells.

4. The pressure hull of claim 1 wherein a said cell is fabricated from three elements, namely upper and lower domed portions, and an intermediate truncated spherical portion connected at its upper and lower edges respectively with said upper and lower domed portions.

5. The pressure hull of claim 1 wherein there are six said cells arrayed in a hexagonal pattern having said central open area.

6. The pressure hull of claim 1 wherein said additional cell is secured to all said surrounding cells.

7. The pressure hull of claim 1 further including bulkheads within said hoops.

8. A pressure hull for submersibles or submarines comprising a plurality of substantially spherical cells, each said cell being truncated at at least one point to define an opening of limited arcuate extent communicating interiorly of said cell, said cells being arranged in a closed loop array with a said opening in each said cell confronting a like opening in the next adjacent said cell, and with said array defining an open area centrally thereof, means fixedly securing said cells to each other in leakproof relation at said confronting openings, thereby to define a connected internal space between at least two said cells for utilization, a pair of spherically curved domes overlying and underlying said central area, means securing said domes to said cells in leakproof relation thereto, thereby to define a sealed usable central space within said loop array, and, at least one access port on the outer face of at least one said cell for entry to and exit from said cell internal space.

9. The pressure hull of claim 8 further including at least one access port on the inner face of one of said cells communicating with said central area.

10. A submersible or submarine comprising an external hydrodynamic hull and a plurality of substantially spherical cells disposed within said hydrodynamic hull to define a pressure hull therewithin, each said cell being truncated at two spaced points to define two openings of limited arcuate extent, said cells being arranged in a loop array with a said opening in each said cell confronting a like opening in the next adjacent said cell, and with said array defining an open area centrally thereof, a pair of spherically curved domes overlying and underlying said central area, means securing said domes to said cells in leakproof relation thereto, thereby to define a sealed usable central space within said loop array, means fixedly securing said cells to each other at said confronting openings in leakproof relation, thereby to define a loop-like connected internal space for utilization, said connecting means including a circular hoop about each pair of said confronting openings and secured to each adjacent cell thereat, and, at least one access port on the outer face of at least one said spherical cell.

11. The submersible or submarine of claim 10 wherein bracing connections extend between said hoops and said external hull, thereby to support the same and fixedly locate said pressure hull therewithin rigidly supported against bending stresses.

12. The submersible or submarine of claim 10 wherein said spherical cell openings each extend over an arc of no greater than about 75°.

13. The submersible or submarine of claim 10 wherein there are at least five said cells arranged in a substantially planar array to define said open area centrally thereof within said external hull.

14. The submersible or submarine of claim 13 wherein there are six said cells arrayed in a hexagonal pattern having said central open area.

15. The submersible or submarine of claim 10 further including at least one access port on the inner face of one of said cells communicating with said central open area.

16. A submersible or submarine comprising an external hydrodynamic hull and a plurality of substantially spherical cells disposed within said hydrodynamic hull to define a pressure hull therewithin, each said cell being truncated at two spaced points to define two openings of limited arcuate extent, said cells being arranged in a loop array with a said opening in each said cell confronting a like opening in the next adjacent said cell, and with said array defining an open area centrally thereof, an additional said cell disposed in said central open area and having a said opening therein, wherein further at least one of said loop array cells has a complementary opening communicating with said additional cell, and, means sealing and securing said cells in leakproof relation to each other.

17. The submersible or submarine of claim 16 wherein said additional spherical cell is secured to all said surrounding spherical cells.

18. A submersible or submarine comprising an external hydrodynamic hull of substantially streamlined planar configuration and a plurality of substantially spherical cells disposed within said hydrodynamic hull to define a pressure hull therewithin, each said cell being truncated at two spaced points to define two openings of limited arcuate extent, said cells being arranged in a loop array with a said opening in each said cell confronting a like opening in the next adjacent said cell, and with said array defining an open area centrally thereof, a pair of spherically curved domes overlying and underlying said central area, means securing said domes to said cells in leakproof relation thereto, thereby to define a sealed usable central space within said loop array, means fixedly securing said cells to each other at said confronting openings in leakproof relation, thereby to define a loop-like connected internal space through said cells for utilization, and, at least one access port between one of said cells and said central space within said domes.

19. The submersible or submarine of claim 1 wherein said fixedly securing means at said cell openings further include bracing means extending radially therefrom and fixed to the interior of said hydrodynamic hull.

* * * * *